US006832979B1

(12) United States Patent
Yarbrough

(10) Patent No.: US 6,832,979 B1
(45) Date of Patent: Dec. 21, 2004

(54) MOBILE SPRING BOARD CONSTRUCTION

(76) Inventor: Jesse D. Yarbrough, 3 Hill St., Amesbury, MA (US) 01913

( * ) Notice: Subject to any disclaimer, the term of this patent is extended or adjusted under 35 U.S.C. 154(b) by 0 days.

(21) Appl. No.: 10/390,247

(22) Filed: Mar. 17, 2003

Related U.S. Application Data

(60) Provisional application No. 60/365,263, filed on Mar. 18, 2002.

(51) Int. Cl.[7] ..... A63B 25/10

(52) U.S. Cl. ..... 482/77; 482/79; 482/121

(58) Field of Search ..... 482/121, 123, 482/77, 908, 78, 79, 51, 74, 80; D21/167; 36/7, 8, 114

(56) References Cited

U.S. PATENT DOCUMENTS

| | | | | |
|---|---|---|---|---|
| 432,721 | A | | 7/1890 | Berry |
| 577,428 | A | | 2/1897 | Hawes |
| 1,638,350 | A | | 8/1927 | Long |
| 2,377,504 | A | | 6/1945 | Lermont |
| 3,260,531 | A | | 7/1966 | Heuvel |
| 3,260,532 | A | | 7/1966 | Heuvel |
| 3,301,569 | A | * | 1/1967 | Broschart |
| 3,377,722 | A | | 4/1968 | Downing |
| 3,522,953 | A | | 8/1970 | Gold et al. |
| 4,123,080 | A | | 10/1978 | Agajanian |
| 4,180,260 | A | | 12/1979 | Slagle |
| 4,196,903 | A | | 4/1980 | Illustrato |
| 4,492,374 | A | | 1/1985 | Lekhtman et al. |
| 5,080,382 | A | | 1/1992 | Franz |
| 5,205,798 | A | | 4/1993 | Lekhtman |
| 5,292,295 | A | * | 3/1994 | Gerlach ..... 482/77 |
| 5,352,176 | A | | 10/1994 | Huang |
| 5,795,277 | A | | 8/1998 | Bruntmyer |
| 5,916,071 | A | | 6/1999 | Lee |
| 6,196,558 | B1 | | 3/2001 | Simon |
| 6,346,065 | B1 | | 2/2002 | Lapointe |

* cited by examiner

*Primary Examiner*—Jerome W. Donnelly
(74) *Attorney, Agent, or Firm*—O'Connell Law Firm

(57) ABSTRACT

A spring board construction in one embodiment with a board member, first and second bindings, and first and second spring units coupled to the board member. The spring units can have resiliently deflectable upper and lower arcuate spring members joined in an opposing relationship. The spring units can be disposed generally parallel to one another and perpendicular to a longitudinal dimension of the board member. The first and second ends of the upper and lower arcuate spring members can be fixed together by being mutually enveloped in first and second encasements. The spring members can be crafted from a composite of plastic and fiberglass. Traction members can be fixed to mid-portions of the lower spring members.

28 Claims, 4 Drawing Sheets

MOBILE SPRING BOARD CONSTRUCTION

This application claims the benefit of U.S. Provisional Application No.: 60/365,263 filed Mar. 18, 2002.

FIELD OF THE INVENTION

The present invention relates generally to devices for use in exercise and acrobatics. Stated more particularly, this patent discloses and protects a mobile spring board construction for enabling exercise and the practice of aerial board maneuvers.

BACKGROUND OF THE INVENTION

It will be appreciated that snowboarding, skateboarding, wakeboarding, surfing, and other board sports provide participants with fun and exercise in a wide variety of environments and conditions. In each boarding sport, the participant communicates along a supporting surface, whether it be snow, water, pavement, or another surface, by sliding, rolling, or the like while twisting, turning, and, quite often, briefly 'catching air' thereby enabling the performance of aerial maneuvers and tricks.

In each sport, the participant or prospective participant will normally wish to precondition his or her muscles to enable the athlete to participate effectively in the sport and, ideally, to execute the often physically and athletically demanding tricks and maneuvers involved therein. Furthermore, the participating athlete will often hope to practice and perfect the challenging tricks and maneuvers involved in his or her particular sport even when participation in the actual sport is not possible. For example, while a snowboarder might very much desire to be able to practice aerial tricks and maneuvers in the summertime or while away from the slope, the ability to do so has heretofore been unavailable. Still further, many persons may simply seek to participate in and indeed develop challenging and novel forms of exercise, sport, and recreation without necessarily gearing the exercise, sport, and recreation toward participation in any other sport.

As one knowledgeable in the art will be well aware, the prior art is replete with a variety of devices intended to enable the user to jump, bounce, exercise, and, at least nominally, to practice aerial maneuvers. One common type of prior art bouncing arrangement comprises a pair of separate boots each with a spring arrangement coupled thereto. While useful in providing the user with exercise, these individual bouncing boot arrangements do not enable a participant to simulate and practice with any realism the maneuvers and tricks involved in boarding activities where both feet are disposed on a unitary structure. Other bouncing arrangements have been disclosed employing skateboard-type boards with spring-loaded telescoping members projecting from the lower surface of the board. Such arrangements have proven to be disadvantageously limited in their durability and bouncing ability while also being relatively complex in structure and operation. As a result, the practicing of aerial maneuvers and tricks employing such structures is effectively prevented. At least one other inventor has proposed employing a snowboard variant relative to a trampoline for bouncing and practicing aerial maneuvers. However, not only must the user of such an arrangement purchase or otherwise gain access to a trampoline, the user is limited to bouncing on only in a predetermined location, namely the very central portion of the trampoline. Furthermore, he or she must assemble and disassemble the trampoline while also providing a location for setting it up and bouncing on it.

In light of the above-described state of the art, it becomes clear that a bouncing arrangement that would enable the realistic practice and simulation of aerial board maneuvers and tricks would be of great utility not only to actual or prospective participants in board sports but also to those simply seeking an advantageous and novel form of exercise and recreation.

SUMMARY OF THE INVENTION

Advantageously, the present invention is founded on the most broadly stated object of providing a mobile spring board construction that meets one or more of the needs left by the prior art while providing a number of heretofore unrealized advantages thereover.

A more particular object of certain embodiments of the invention is to provide a mobile spring board construction that enables a user to bounce and to engage in aerial maneuvers and tricks.

A related object of embodiments of the invention is to provide a mobile spring board construction that enables users to simulate and practice aerial maneuvers and tricks commonly undertaken in board activities, such as snowboarding.

A further related object of embodiments of the invention is to provide a mobile spring board construction that enables users to develop a form of exercise, sport, and amusement that is novel in its own right.

In certain embodiments, another object of the invention is to provide a mobile spring board construction that enables a user to bounce bound, and maneuver to significant heights above a ground surface.

A further object of embodiments of the invention is to provide a mobile spring board construction that can be used in a wide variety of terrains and conditions.

Yet another object of embodiments of the invention is to provide a mobile spring board construction that demonstrates durability while remaining relatively simple in construction and orientation.

An even further object of certain embodiments of the invention is to provide a mobile spring board construction that is stable and safe in operation.

Still another object of particular embodiments of the invention is to provide a mobile spring board construction that can be adapted to varying capacities to accommodate different users and varied user abilities and goals.

These and further objects and advantages of the invention will become obvious not only to one who reviews the present specification and drawings but also to one who has an opportunity to make use of an embodiment of the present invention for a mobile spring board construction. However, it will be appreciated that, although the accomplishment of each of the foregoing objects in a single embodiment of the invention may be possible and indeed preferred, not all embodiments will seek or need to accomplish each and every potential object and advantage. Nonetheless, all such embodiments should be considered within the scope of the present invention.

In carrying forth these and further objects, a most basic embodiment of the mobile spring board construction is founded on a board member that has an upper surface, a lower surface, a first end, and a second end. Means, such as individual bindings, are provided for receiving each of the first and second feet of the user relative to the board member. At least a first spring unit, which can be formed by upper and lower arcuate spring members joined in an opposing relationship, is coupled to the board member. Under even this most basic arrangement, a user can dispose both feet on the board member of the mobile spring board construction to enable him or her to bounce thereon by inducing a deflection of the upper and lower arcuate spring members of the first spring unit.

Each of the upper and lower arcuate members can have a first end, a second end, and an arcuate mid-portion, and the spring unit can be coupled to the board member by a coupling of the mid-portion of the upper arcuate spring member with the board member. The means for receiving the first and second feet of the user can be open areas on the upper surface of the board member in combination with means, such as straps, for retaining the feet of the user. The open areas can simply comprise portions of the upper surface of the board member, or they could comprise first and second footplates each possibly having a peripheral wall.

A second, similarly constructed spring unit could additionally be coupled to the board member. In such a case, the upper and lower arcuate spring members of the spring units can be disposed in a generally parallel relationship to one another and perpendicular to a longitudinal dimension of the board member. The board member can be a unitary member of, for example, a high impact plastic, and it can have a plurality of apertures therethrough.

The ends of the upper and lower arcuate members can be coupled in any one of a variety of ways. Under one construction, the first and second ends can be fixed together by first and second encasements that mutually envelope at least a portion of the respective first and second ends of each of the upper and lower arcuate spring members. Within the encasements, the first and second ends of the upper arcuate spring member could overhang the first and second ends of the lower arcuate spring member. The encasements can be formed from any suitable material including, by way of example, a volume of polymeric material. For added structural integrity, at least one surface variation chosen from the group consisting of an aperture, an indentation, and a protuberance can be disposed in or on each of the first and second ends of each of the upper and lower arcuate spring members within the first and second encasements.

The upper and lower arcuate spring members can be formed from any appropriate material, such as metal, plastic, a composite, or any other suitable material or combination of materials. Under one construction of the mobile spring board, the upper and lower arcuate spring members can be formed from a composite structural material of plastic and fiberglass. For added traction and stability, traction members can be fixed to the mid-portions of the lower arcuate spring members of the spring units. Still further, the performance of the mobile spring board construction can be modified by a refinement of the shapes of the upper and lower arcuate spring members. For example, the upper and lower arcuate spring members can vary in width and thickness to have mid-portions that are wider and thicker than their first and second ends.

One will appreciate that the foregoing discussion broadly outlines the more important features of the invention to enable a better understanding of the detailed description that follows and to instill a better appreciation of the inventor's contribution to the art. Before an embodiment of the invention is explained in detail, it must be made clear that the following details of construction, descriptions of geometry, and illustrations of inventive concepts are mere examples of the many possible manifestations of the invention.

DETAILED DESCRIPTION OF PREFERRED EMBODIMENTS

As with many inventions, the present invention for a mobile spring board construction can assume a wide variety of embodiments. However, to assist those reviewing the present disclosure in understanding and, in appropriate circumstances, practicing the present invention, certain exemplary embodiments of the mobile spring board construction are described below and shown in the accompanying drawing figures.

Figure 1:
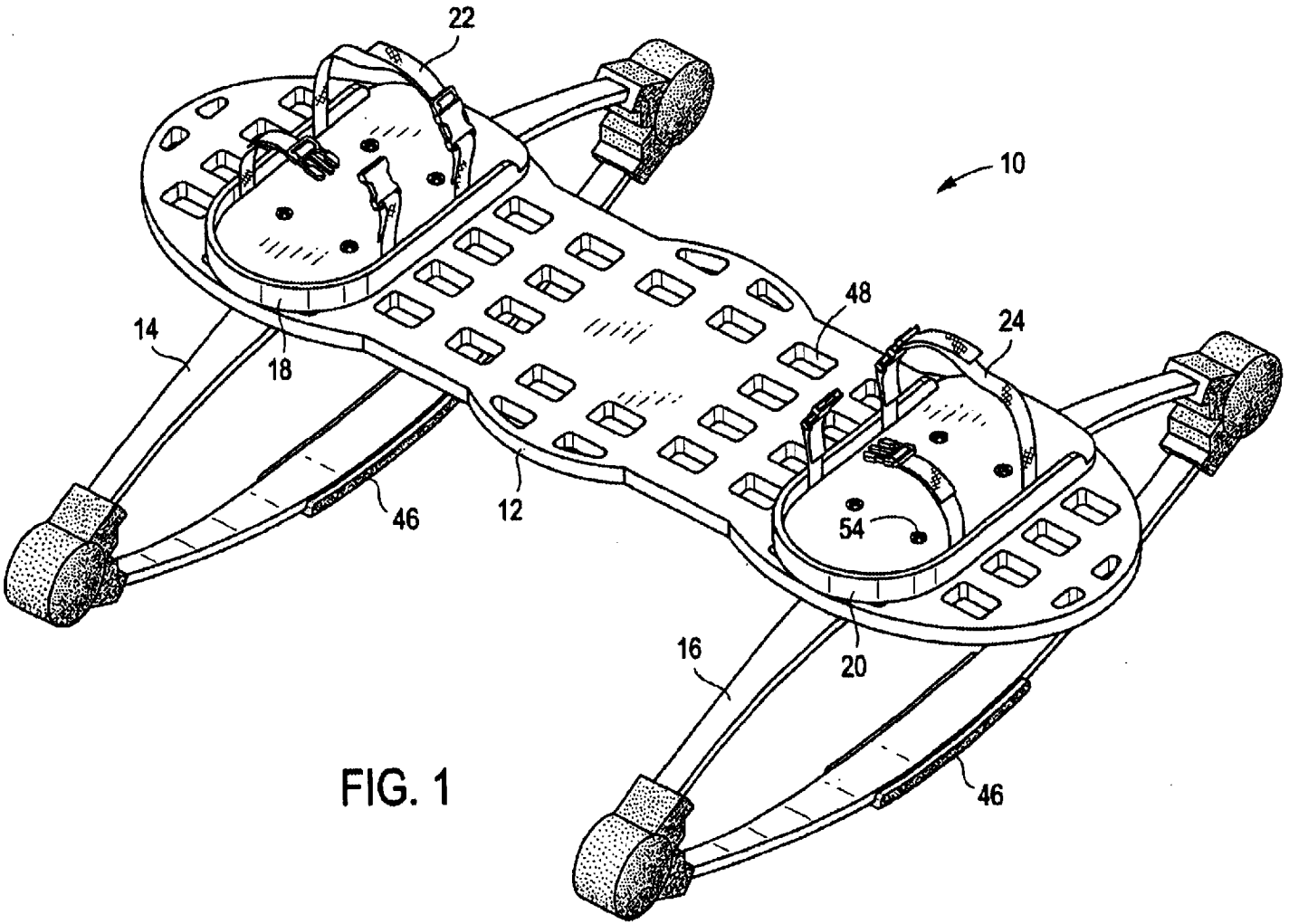
FIG. 1 is a perspective view of a mobile spring board construction according to the present invention.

Looking more particularly to the drawings, an exemplary embodiment of the present invention for a mobile spring board construction is indicated generally at 10 in FIG. 1. There, the mobile spring board construction 10 is founded on a board member 12 that has upper and lower surfaces and first and second ends. A first spring unit 14 is secured to the lower surface of the board member 12 adjacent to the first end thereof while a second spring unit 16 is secured to the lower surface of the board member 12 adjacent to the second end thereof. First and second bindings 18 and 20 are disposed on the upper surface of the board member 12 for receiving the feet of a user. Straps 22 are provided relative to the first binding 18 for securing the right foot of the user relative to the first binding 18 and the mobile spring board construction 10 in general. Similarly, straps 24 are provided relative to the second binding 20 for securing the left foot of the user relative to the second binding 20 and the mobile spring board construction 10 in general.

The board member 12 could be formed from one or more of a wide variety of materials and in numerous different configurations. For example, the board member 12 could be formed, such as by molding, cutting, carving, or any other suitable method, from any appropriately selected metal, wood, polymer, or other material. As such, the board member 12 could comprise a single layer of material, a laminate of multiple layers of similar or different materials, or any other structure. In this exemplary embodiment, the board member 12 is formed as a unitary member from an impact resistant plastic by an injection molding process. The board member 12 has a plurality of apertures 48 formed therein for reducing the weight and material consumption of the board member 12.

The first and second bindings 18 and 20 also could be formed in a variety of ways under the present invention. For example, the first and second bindings 18 and 20 could be integrated directly into the board member 12 with any appropriate means being provided for effectively retaining a user's respective foot relative thereto. Indeed, the first and second bindings 18 and 20 could simply comprise straps 22 and 24 in combination with an open area on the upper surface of the board member 12. The open area could be even with, above, or below the surrounding portions of the board member 12. The straps 22 and 24 could simply comprise resilient strips of material. Alternatively or additionally, each of the straps 22 and 24 could be formed from first and second members with a means for detachably coupling the first and second members in a securing configuration about a user's foot. That coupling means could comprise, for example, the male/female clips shown relative to the straps 22 and 24 in FIG. 1. Alternatively, the coupling means could comprise portions of hook and loop material as is shown relative to the straps 24 in FIG. 2. Within the terms of the present disclosure, therefore, the term binding should be deemed to include any structure or arrangement capable of retaining a user's foot or feet relative to the board member 12. With that in mind, it will be clear that one knowledgeable in the art would find still other binding arrangements obvious after reviewing the present disclosure.

Figure 2:
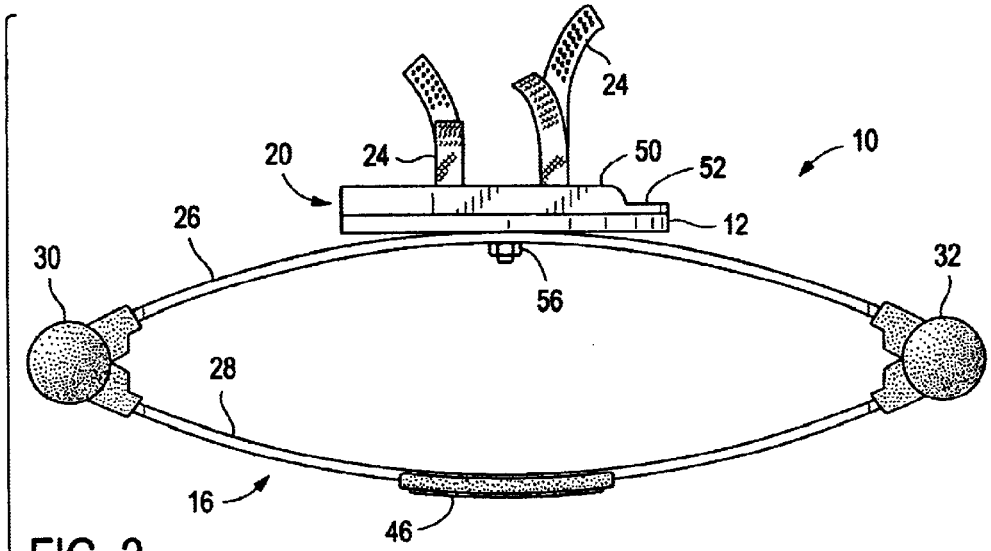
FIG. 2 is a view in side elevation of a variant of the mobile spring board construction.

In this example, as can be seen best in FIG. 2 relative to the second binding 20, the first and second bindings 18 and 20 can each be formed by a footplate 52 in combination with the straps 24. A peripheral wall 50 can be fixed to the footplate 52 as by being formed integrally therewith for helping to maintain the user's foot in a proper location and orientation. The footplate 52 can be secured to the board member 12 by any appropriate method, such as by a plurality of fasteners 54 as is shown in FIG. 1.

Figure 3:
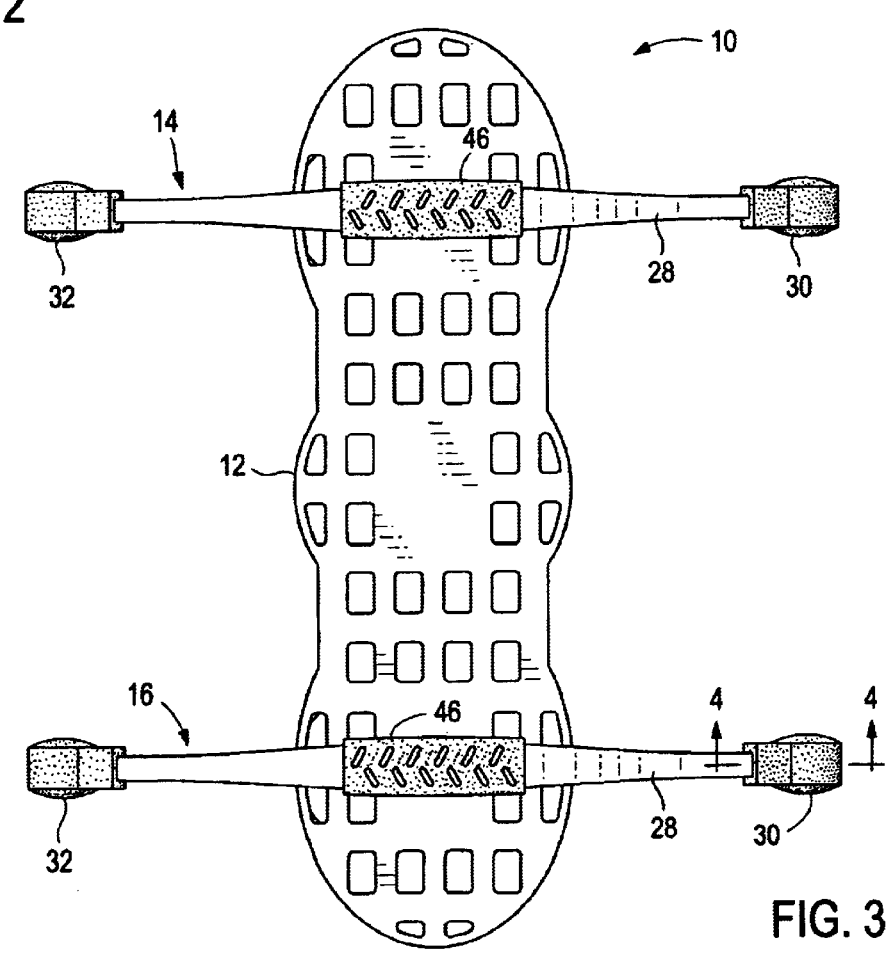
FIG. 3 is a bottom plan view of the mobile spring board construction.

With combined reference to FIGS. 1, 2, and 3, one sees that the first and second spring units 14 and 16 are each formed by resiliently deflectable upper and lower arcuate spring members 26 and 28. The upper and lower spring members 26 and 28 are fixed in an opposing relationship by a joining of their respective end portions. The spring units 14 and 16 can be fastened to the board member 12 by any appropriate method, such as by a clamping arrangement, a clip, a mechanical fastener, an adhesive, by welding, or by any other effective means. In this embodiment, the fastening is carried out by a mechanical fastener 56.

Figure 4:
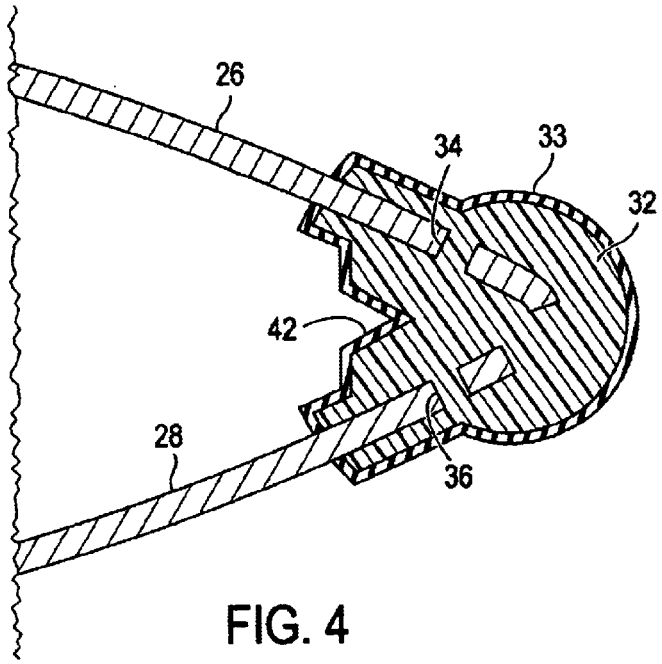
FIG. 4 is a cross-sectional view of a spring unit end portion taken along the line 4-4 in FIG. 3.

Similarly, the end portions of the upper and lower arcuate spring members 26 and 28 could be joined in any effective manner. One presently preferred coupling arrangement is shown in FIGS. 1 through 4. There, the first and second ends of the upper and lower arcuate spring members 26 and 28 are joined by being mutually enveloped within first and second encasements 30 and 32 respectively. These exemplary encasements 30 and 32 are formed from a volume of a polymer, which can be a plastic such as polypropylene. With the encasements 30 and 32 so formed, they could be encased in a rubber shell 33, such as by being dipped in a volume of liquid rubber. As is shown in FIG. 4 relative to the second encasement 32, the ends of each of the upper and lower arcuate members 26 and 28 are embedded in the volume of material forming the encasement 32 with the end of the upper arcuate spring member 26 overhanging the end of the lower arcuate spring member 28. Such an association has been found to enhance the durability, stability, and reliability of the coupling arrangement.

Each of the upper and lower arcuate members 26 and 28 has one or more apertures 34 and 36 therein through which a portion of the volume of encasing material can pass for better securing the upper and lower arcuate members 26 and 28 and the encasement 32 in a mutually joined relationship. Further or other surface variations, such as impressions, indentations, or protuberances, could be formed in the ends of the upper and lower arcuate members 26 and 28 for ensuring a secure joining of the arcuate members 26 and 28.

It has been realized that the ability of the upper and lower arcuate members 26 and 28 to deflect relative to one another under such a construction will be affected by, among other things, the nature of the material employed to form the encasements 30 and 32 and the degree to which the encasements 30 and 32 overlie the upper and lower arcuate members 26 and 28. Furthermore, it has been determined that the deflection of the upper and lower arcuate members 26 and 28 can be affected by the provision of a relief cut or formation 42 formed in the encasement 32 between the end portions of the arcuate members 26 and 28 as is shown in FIG. 4. With this, these characteristics can be manipulated under the present invention, possibly in combination with other aspects of the mobile spring board construction 10, to affect and control its performance.

Figure 5:
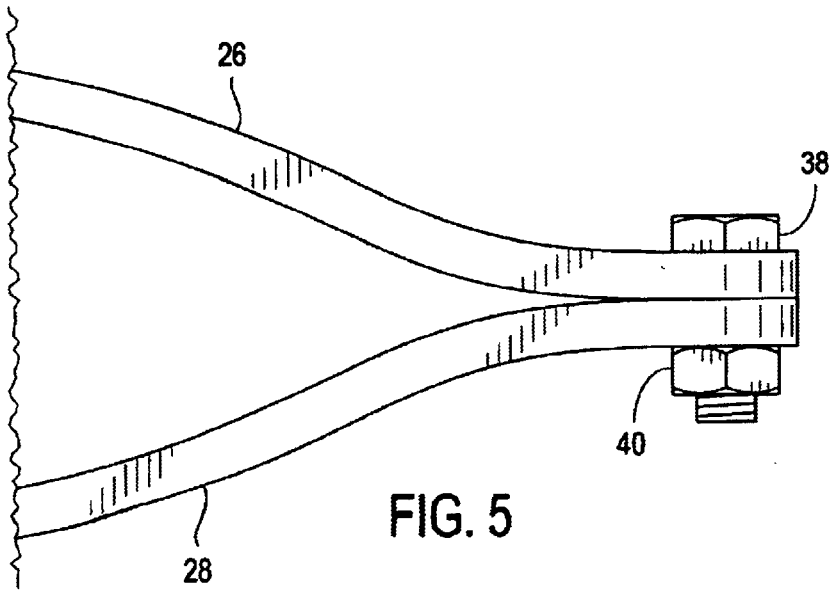
FIG. 5 is a view in side elevation of an alternative spring unit end portion according to the present invention.

FIG. 5 shows one of the many alternative methods by which the upper and lower arcuate members 26 and 28 could be secured together. There, upper and lower arcuate members 26 and 28 are formed to have end portions that reverse curve to assume a facing relationship. A mechanical fastener, such as a bolt 38, passes through the end portions of the upper and lower arcuate members 26 and 28, and a mating mechanical fastener, such as a nut 40, is engaged with the bolt 38. With this, the upper and lower arcuate members 26 and 28 can be joined in a relatively simply yet secure manner. Other methods for securing the upper and lower arcuate members 26 and 28 are possible and within the scope of the present invention.

In FIGS. 1–3 and 8, each of the first and second spring units 14 and 16 has a traction member 46 secured to the lower surface of its lower arcuate member 28 for making contact with a ground surface (not shown) to prevent slippage of the mobile spring board construction 10 and to prevent or limit damage to and wear on the lower arcuate member 28 and the mobile spring board construction 10 in general. While the traction member 46 could be formed from any one of a variety of materials within the scope of the invention, it is presently preferred to form the traction member 46 from rubber with a plurality of protruding knobs for enhanced traction. The traction members 46 can be secured to the lower arcuate members 28 by adhesive or any other suitable means.

Figure 6:
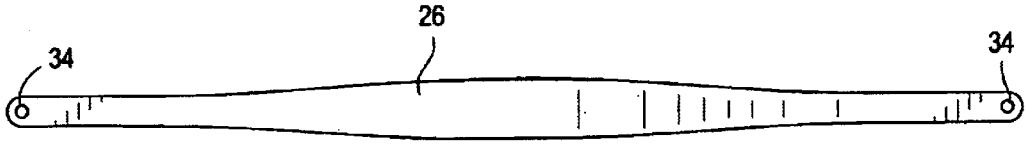
FIG. 6 is a plan view of a possible spring member under the present invention.
Figure 7:
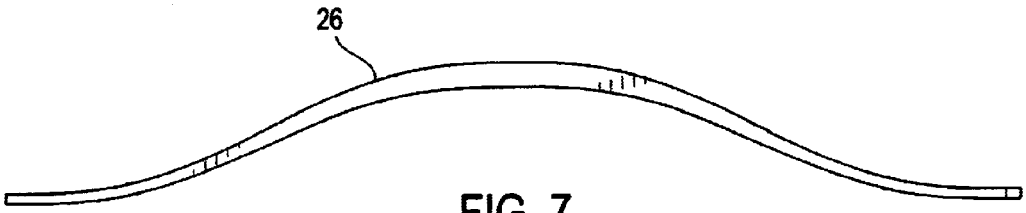
FIG. 7 is a view in side elevation of the spring member of FIG. 6.

The upper and lower arcuate members 26 and 28 could be crafted with a wide variety of shapes and cross sections. Under a most simple construction, the arcuate members 26 and 28 could be of a consistent thickness and width over their entire lengths, and they could have a smooth are of a generally consistent radius along their lengths as exemplified in FIG. 4. Alternatively, one or both arcuate members 26 and 28 could be arcuate along its central portion while its end portions could be counter-curved to approach a generally parallel orientation as is shown in FIG. 5. Furthermore, the arcuate members 26 and 28 could vary in thickness and width over their lengths to achieve desired performance characteristics. As is shown most clearly in the plan and side views of FIGS. 6 and 7, one preferred embodiment of an upper arcuate member 26, which is exemplary of the upper and lower arcuate members 26 and 28, could vary smoothly in width from relatively thin end portions to a thicker central portion. Similarly, the thickness of the upper and lower arcuate members 26 and 28 can increase progressively from the end portions to the central portion.

Of course, the thicknesses, shape, durability, appearance, weight, and other characteristics of the upper and lower arcuate members 26 and 28 will be dictated and affected to a great extent by the material from which the arcuate members 26 and 28 are formed. The upper and lower arcuate members 26 and 28 could be formed from substantially any material or combination of materials that would enable the arcuate members 26 and 28 to be resiliently deflectable. As such, the upper and lower arcuate members 26 and 28 could be formed from a metal, such as spring steel; a plastic; a laminate; a composite; and any other suitable material or combination of materials. Under one presently preferred embodiment, the upper and lower arcuate members 26 and 28 are formed from a composite structural material of plastic and fiberglass and are compression molded such that they are durable and relatively light while demonstrating resilient compressibility over numerous cycles.

Figure 8:
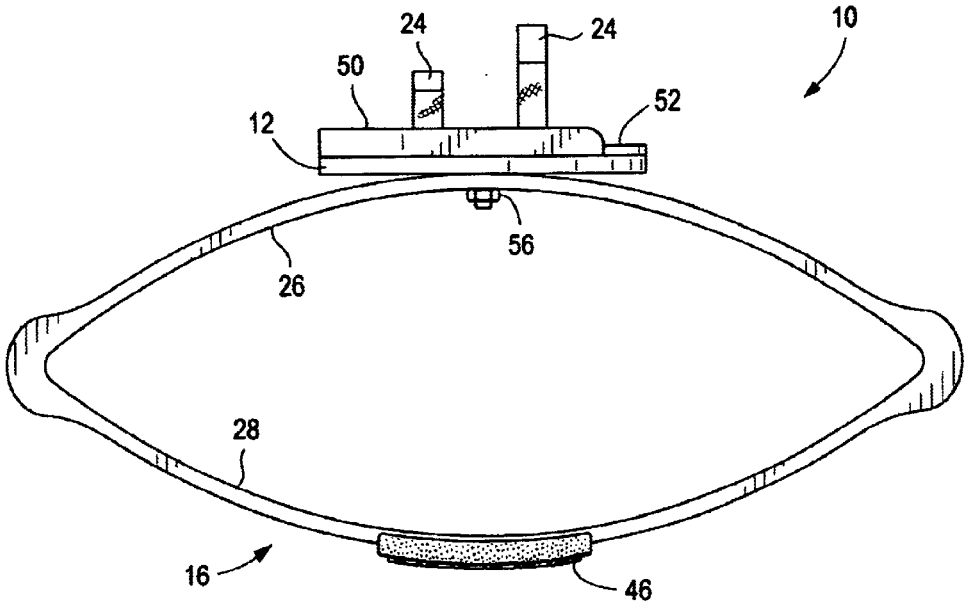
FIG. 8 is a view in side elevation of an alternative embodiment of the mobile spring board construction.

While the upper and lower arcuate members 26 and 28 have been shown and described thus far as individual elements, it should be clear that in certain embodiments of the mobile spring board construction 10 the arcuate members 26 and 28 could be integrally formed as portions of a single structure forming the first and second spring units 14 and 16 as is exemplified in the mobile spring board construction 10 shown in FIG. 8. There, the second spring unit 16 is shown with the upper and lower arcuate members 26 and 28 are formed unitarily with merged end portions. As before, the arcuate members 26 and 28 could be formed from any appropriate material, such as metal, plastic, or a composite, such as plastic and fiberglass.

It will be appreciated that the shapes, dimensions, and relative dispositions of the board member 12, the first and second spring units 14 and 16, the first and second bindings 18 and 20, and other components of the mobile spring board construction 10 will be dictated not only by the design and manufacturing considerations but also by the goals, abilities, and size of the user. For example, it is possible that just one spring unit 14, which could be relatively narrow or relatively wide, could be employed or that more than first and second spring units 14 and 16 could be fixed to the board member 12. Also, the relative locations and, possibly, the orientations of the first and second spring units 14 and 16 can be altered. Furthermore, certain embodiments of the mobile spring board construction 10 could be designed for light duty usage, such as by children, beginners, or the casual user, while other embodiments could be designed for heavy duty usage, such as by larger and more experienced users. Under one construction, the arcuate members 26 and 28 can have an overall length of roughly twenty-four inches, the end portions can be approximately ¾ inches wide and approximately ¼ inch thick, and the central portion can be approximately 1.5 inches wide and ⅜ inches thick.

In any case, it will be appreciated that the disclosed mobile spring board construction 10 can be employed by a user in a most simple and convenient manner to engage in exercise, to practice aerial maneuvers, and generally to enjoy a safe form of recreation. To do so, the user need only insert his or her feet into the first and bindings 18 and 20 and secure them in place using the straps 22 and 24 or any other retaining means that is provided. With the mobile spring board construction 10 thus ready for use, the user can bounce up and down, laterally, forward, and backward on a wide variety of surfaces simply by repeatedly inducing a resilient deflection of the first and second spring units 14 and 16. Not only can the user exercise and, if desirable, travel employing the mobile spring board construction 10, but the user can also practice aerial maneuvers, such as those common to snowboarding, skateboarding, and other activities in a most realistic simulation of the actual activities.

Advantageously, while the user is performing such maneuvers, he or she will further enjoy the safety and stability presented by the broad, stable footprint offered by the mobile spring board construction 10. That broad footprint can be appreciated with reference to FIG. 3 where one sees that the mobile spring board construction 10 presents a footprint that is as wide as the distance between the outer edges of the first and second spring units 14 and 16 and as deep as the overall length of the first and second spring units 14 and 16. With this, the user can bounce, tilt, and otherwise maneuver with little fear or risk of toppling. The stability of the mobile spring board construction 10 is improved still further by the traction members 46 such that the device can be employed by users on a wide variety of terrains and in a wide variety of applications.

With a plurality of exemplary embodiments of the present invention for a mobile spring board construction 10 disclosed, it will be appreciated by one skilled in the art that numerous changes and additions could be made thereto without deviating from the spirit or scope of the invention. This is particularly true when one bears in mind that the presently preferred embodiments merely exemplify the broader invention revealed herein. Accordingly, it will be clear that those with major features of the invention in mind could craft embodiments that incorporate those major features while not incorporating all of the features included in the preferred embodiments.

Therefore, the following claims are intended to define the scope of protection to be afforded to the inventor. However, those claims shall be deemed to include equivalent constructions insofar as they do not depart from the spirit and scope of the invention. It must be further noted that a plurality of the following claims may express certain elements as means for performing a specific function, at times without the recital of structure or material. As the law demands, these claims shall be construed to cover not only the corresponding structure and material expressly described in this specification but also equivalents thereof.

What is claimed is:

1. A spring board construction for enabling a user to bounce with both feet disposed thereon the spring board construction comprising:

a board member with an upper surface, a lower surface, a first end, and a second end;

a means for receiving a first foot of the user relative to the board member;

a means for receiving a second foot of the user relative to the board member; and a first spring unit coupled to the board member wherein the first spring unit comprises a resiliently deflectable upper arcuate spring member with a first end, a second end, and an arcuate mid-portion and a resiliently deflectable lower arcuate spring member with a first end, a second end, and an arcuate mid-portion; wherein the upper and lower arcuate spring members are coupled in an opposing relationship; and wherein the first spring unit is coupled to the board member by a coupling of the mid-portion of the upper arcuate spring member with the board member.

2. A spring board construction for enabling a user to bounce with both feet disposed thereon, the spring board construction comprising:

a board member with an upper surface, a lower surface, a first end, and a second end;

a means for receiving a first foot of the user relative to the board member;

a means for receiving a second foot of the user relative to the board member; and a first spring unit coupled to the board member wherein the first spring unit comprises a resiliently deflectable upper arcuate spring member with a first end, a second end, and an arcuate mid-portion and a resiliently deflectable lower arcuate spring member with a first end, a second end, and an arcuate mid-portion wherein the upper and lower arcuate spring members are coupled in an opposing relationship;

wherein the means for receiving the first foot of the user relative to the board member comprises an area on the upper surface of the board member for receiving the first foot of the user and a means for retaining the first foot of the user and wherein the means for receiving the second foot of the user relative to the board member comprises an area on the upper surface of the board member for receiving the second foot of the user and a means for retaining the second foot of the user.

3. The spring board construction of claim 2 wherein the means for retaining the first foot of the user comprises at least one strap and wherein the means for retaining the second foot of the user comprises at least one strap.

4. The spring board construction of claim 3 wherein the area for receiving the first foot of the user comprises a first footplate with a peripheral wall fixed to the board member and wherein the area for receiving the second foot of the user comprises a second footplate with a peripheral wall fixed to the board member.

5. A spring board construction for enabling a user to bounce with both feet disposed thereon, the spring board construction comprising:

a board member with an upper surface, a lower surface, a first end, and a second end;

a means for receiving a first foot of the user relative to the board member;

a means for receiving a second foot of the user relative to the board member;

a first spring unit coupled to the board member wherein the first spring unit comprises a resiliently deflectable upper arcuate spring member with a first end, a second end, and an arcuate mid-portion and a resiliently deflectable lower arcuate spring member with a first end, a second end, and an arcuate mid-portion wherein the upper and lower arcuate spring members are coupled in an opposing relationship; and a second spring unit coupled to the board member wherein the second spring unit comprises a resiliently deflectable upper arcuate spring member with a first end, a second end, and an arcuate mid-portion and a resiliently deflectable lower arcuate spring member with a first end, a second end, and an arcuate mid-portion wherein the upper and lower arcuate spring members are coupled in an opposing relationship.

6. The spring board construction of claim 5 wherein the upper and lower arcuate spring members of the first spring unit are disposed in a generally parallel relationship to the upper and lower arcuate spring members of the second spring unit.

7. The spring board construction of claim 6 wherein the first spring unit is disposed adjacent to the first end of the board member and wherein the second spring unit is disposed adjacent to the second end of the board member.

8. The spring board construction of claim 6 wherein the board member has a longitudinal dimension from its first end to its second end and wherein the upper and lower arcuate spring members of the first and second spring units are disposed generally perpendicular to that longitudinal dimension.

9. The spring board construction of claim 9 wherein the board member comprises a unitary member.

10. The spring board construction of claim 9 wherein the unitary member is formed from impact resistant plastic with a plurality of apertures therethrough.

11. The spring board construction of claim 5 wherein the upper and lower arcuate spring members are coupled by a means for fixing the first ends of the upper and lower arcuate spring members together and a means for fixing the second ends of the upper and lower arcuate spring members together.

12. The spring board construction of claim 11 wherein the means for fixing the first ends of the upper and lower arcuate spring members together comprises a first encasement that mutually envelopes at least a portion of the first ends of each of the upper and lower arcuate spring members and wherein the means for fixing the second ends of the upper and lower arcuate spring members together comprises a second encasement that mutually envelopes at least a portion of the second ends of each of the upper and lower arcuate spring members.

13. The spring board construction of claim 12 wherein the first and second ends of the upper arcuate spring member overhang the first and second ends of the lower arcuate spring member.

14. The spring board construction of claim 12 wherein the first and second encasements each comprise a volume of polymeric material.

15. The spring board construction of claim 14 further comprising at least one surface variation chosen from the group consisting of an aperture, an indentation, and a protuberance in or on each of the first and second ends of each of the upper and lower arcuate spring members within the first and second encasements.

16. The spring board construction of claim 14 wherein the upper and lower arcuate spring members of the first spring unit are formed from a composite structural material of plastic and fiberglass.

17. A spring board construction for enabling a user to bounce with both feet disposed thereon, the spring board construction comprising:

a board member with an upper surface, a lower surface, a first end, and a second end;

a means for receiving a first foot of the user relative to the board member;

a means for receiving a second foot of the user relative to the board member;

a first spring unit coupled to the board member wherein the first spring unit comprises a resiliently deflectable upper arcuate spring member with a first end, a second end, and an arcuate mid-portion and a resiliently deflectable lower arcuate spring member with a first end, a second end, and an arcuate mid-portion wherein the upper and lower arcuate spring members are coupled in an opposing relationship; and a traction member fixed to the mid portion of the lower arcuate spring member of the first spring unit.

18. A spring board construction for enabling a user to bounce with both feet disposed thereon, the spring board construction comprising:

a board member with an upper surface, a lower surface, a first end, and a second end;

a means for receiving a first foot of the user relative to the board member;

a means for receiving a second foot of the user relative to the board member;

a first spring unit coupled to the board member wherein the first spring unit comprises a resiliently deflectable upper arcuate spring member with a first end, a second end, and an arcuate mid-portion and a resiliently deflectable lower arcuate spring member with a first end, a second end, and an arcuate mid-portion; wherein the upper and lower arcuate spring members are coupled in an opposing relationship; and wherein the upper and lower arcuate spring members vary in width and thickness to have mid-portions that are wider and thicker than their first and second ends.

19. A spring board construction for enabling a user to bounce with both feet disposed thereon, the spring board construction comprising:

a board member with an upper surface, a lower surface, a first end, and a second end;

a means for receiving a first foot of the user relative to the board member;

a means for receiving a second foot of the user relative to the board member;

a first spring unit coupled to the board member wherein the first spring unit comprises a resiliently deflectable upper arcuate spring member with a first end, a second end, and an arcuate mid-portion and a resiliently deflectable lower arcuate spring member with a first end, a second end, and an arcuate mid-portion; wherein the upper and lower arcuate spring members are coupled in an opposing relationship; and wherein the upper and lower arcuate spring members are integrally formed.

20. A spring board construction for enabling a user to bounce with both feet disposed thereon, the spring board construction comprising:

a board member with an upper surface, a lower surface, a first end, a second end, and a longitudinal dimension from the first end to the second end;

a first binding for retaining a first foot of the user relative to the board member;

a second binding for retaining a second foot of the user relative to the board member;

a first spring unit coupled to the board member wherein the first spring unit comprises a resiliently deflectable upper arcuate spring member with a first end, a second end, and an arcuate mid-portion and a resiliently deflectable lower arcuate spring member with a first end, a second end, and an arcuate mid-portion wherein the upper and lower arcuate spring members are coupled in an opposing relationship and wherein the first spring unit is coupled to the lower surface of the board member by a coupling of the mid-portion of the upper arcuate spring member with the board member; and a second spring unit coupled to the board member wherein the second spring unit comprises a resiliently deflectable upper arcuate spring member with a first end, a second end, and an arcuate mid-portion and a resiliently deflectable lower arcuate spring member with a first end, a second end, and an arcuate mid-portion wherein the upper and lower arcuate spring members are coupled in an opposing relationship and wherein the second spring unit is coupled to the lower surface of the board member by a coupling of the mid-portion of the upper arcuate spring member with the board member.

21. The spring board construction of claim 20 wherein the upper and lower arcuate spring members of the first spring unit are disposed in a generally parallel relationship to the upper and lower arcuate spring members of the second spring unit.

22. The spring board construction of claim 21 wherein the first spring unit is disposed adjacent to the first end of the board member and wherein the second spring unit is disposed adjacent to the second end of the board member.

23. The spring board construction of claim 21 wherein the upper and lower arcuate spring members of the first and second spring units are disposed generally perpendicular to that longitudinal dimension.

24. The spring board construction of claim 20 wherein the first ends of the upper and lower arcuate spring members are fixed together by a first encasement that mutually envelopes at least a portion of the first ends of each of the upper and lower arcuate spring members and wherein the second ends of the upper and lower arcuate spring members are fixed together by a second encasement that mutually envelopes at least a portion of the second ends of each of the upper and lower arcuate spring members.

25. The spring board construction of claim 24 further comprising at least one surface variation chosen from the group consisting of an aperture, an indentation, and a protuberance in or on each of the first and second ends of each of the upper and lower arcuate spring members within the first and second encasements.

26. The spring board construction of claim 20 wherein the upper and lower arcuate spring members of the first and second spring units are formed from a composite structural material of plastic and fiberglass.

27. The spring board construction of claim 20 further comprising a traction member fixed to the mid portion of the lower arcuate spring member of each of the first and second spring units.

28. The spring board construction of claim 20 wherein the upper and lower arcuate spring members of each of the first and second spring units are integrally formed.

* * * * *